US005367868A

United States Patent [19]

Billner

[11] Patent Number: 5,367,868

[45] Date of Patent: Nov. 29, 1994

[54] PROCESS AND DEVICE FOR OPEN-END SPINNING

[75] Inventor: Werner Billner, Ingolstadt, Germany

[73] Assignee: Rieter Ingolstadt, Ingolstadt, Germany

[21] Appl. No.: 102,900

[22] Filed: Aug. 6, 1993

[30] Foreign Application Priority Data

Aug. 17, 1992 [DE] Germany ..... 4227099

[51] Int. Cl.[5] ..... D01H 4/30; D01H 4/32

[52] U.S. Cl. ..... 57/409; 57/411; 57/413

[58] Field of Search ..... 57/406, 408, 409, 410, 57/411, 412, 413

[56] References Cited

U.S. PATENT DOCUMENTS

| | | | |
|---|---|---|---|
| 3,511,042 | 5/1970 | Anna-Seidov et al. | 57/413 X |
| 3,511,044 | 5/1970 | Stary | 57/413 X |
| 3,535,868 | 10/1970 | Schiltknecht | 57/413 X |
| 3,620,002 | 11/1971 | Grishin | 57/413 |
| 4,339,910 | 7/1982 | Ali et al. | 57/411 |
| 4,676,059 | 6/1987 | Artzt et al. . | |
| 4,976,099 | 12/1990 | Brockmanns et al. | 57/412 X |

FOREIGN PATENT DOCUMENTS

| | | | |
|---|---|---|---|
| 3922877 | 2/1990 | Germany | 57/413 |

*Primary Examiner*—Daniel P. Stodola
*Assistant Examiner*—William Stryiewski
*Attorney, Agent, or Firm*—Dority & Manning

[57] ABSTRACT

During the production of a yarn, and independently of fiber feeding into the spinning element, the air circling together with the opener roller during spinning is removed from the area of the housing which does not convey fibers by an auxiliary air stream which is so strong that it removes fibers and fiber fragments that have become detached from the opener roller and are circling with the opener roller. The auxiliary air stream removed from the housing is introduced into the spinning rotor in such manner that the fibers which are conveyed with it are deposited on the fiber collection surface. To remove the auxiliary air stream, an auxiliary channel is provided which is connected to the source of negative pressure independently of the fiber feeding channel and at the same time may let out into the spinning element.

18 Claims, 5 Drawing Sheets

PROCESS AND DEVICE FOR OPEN-END SPINNING

BACKGROUND OF THE INVENTION

The instant invention relates to a process for open-end spinning in which a fiber sliver is conveyed by means of a feeding device to an opener roller installed in a housing and is fed pneumatically from there to the fiber collection surface of an open-end spinning element to be spun, and to a device to carry out this process.

In a known device of this type, the inlet opening of an auxiliary channel, whose other end lets out into the fiber feeding channel, is installed between the inlet opening of the fiber feeding channel and the delivery device, as seen in the direction of rotation of the opener roller (DE 39 10 292 A1). It has been shown, however, that the air carrying the fibers cannot be removed in this manner from the space in the opener roller housing between the inlet opening of the fiber feeding channel and the feeding device where small spinning rotors are used, so that the feeding device becomes clogged with fly fibers and the opener roller with circulating fibers.

OBJECTS AND SUMMARY OF THE INVENTION

It is therefore a principal object of the instant invention to create a process and a device by means of which it is possible to remove the air together with the fibers circulating with the rotating opener roller reliably from the housing containing the opener roller, whatever spinning rotor size is selected, in order to avoid fly fibers in the area of the feeding device. Additional objects and advantages of the invention will be set forth in the following description, or will be obvious therefrom, or may be learned by practice of the invention.

The objects are attained by the invention in that independently of the fiber feed into the spinning element during spinning, circulating air is removed from the area of the housing which does not convey fibers by means of an auxiliary air stream which is so strong that it removes circulating fibers and fiber fragments which have become detached from the opener roller. Thanks to the feeding of fibers into the spinning rotor from the auxiliary air stream, independently of the conventional feed, fibers which had not yet become detached from the clothing of the opener roller in the vicinity of the fiber feeding channel are effectively prevented from continuing to rotate with the opener roller and from coming into the vicinity of the feed device. Settling of fibers and fiber fragments in the vicinity of the feeding device, which has been especially exposed to flying fibers, is thus prevented.

In principle it does not matter where the fibers removed from the opener roller housing independently of normal fiber feeding into the spinning rotor go. Since these fibers, which circle past the fiber feeding channel together with the opener roller and which are then removed separately from the fiber feeding channel, are relatively few by comparison with normal fiber feeding, these fibers can also be removed as waste. Preferably however, these fibers are also conveyed back to the spinning process by introducing the auxiliary air stream removed from the housing into the spinning element in such manner that the fibers transported by it are deposited on the fiber collection surface. Here it is advantageous for the fibers conveyed by the auxiliary air stream to be conveyed in the normal direction in which fibers are deposited on the fiber collection surface, so that all the fibers reaching the fiber collection surface are deposited under substantially identical conditions in order to achieve good yarn quality.

To carry out the process, the invention provides for the auxiliary channel to be connected to a source of negative pressure independently of the fiber feeding channel, and for the auxiliary channel to let out advantageously into the spinning element. With a spinning element in the form of a spinning rotor, the rotor diameter, and therefore also the outlet cross-section of the fiber feeding channel, thus do not matter in the removal of fibers and air from the opener roller housing, so that reliable operation is ensured. Fly fibers in the area of the feeding device are thus avoided. The risk of dust clogging is also reduced considerably. Furthermore, the danger that fibers may circle once or several times with the opener roller is reduced considerably.

Although the direction into which the auxiliary channel lets out into the opener roller housing is not of crucial importance, greater effectiveness is achieved if the inlet opening of the auxiliary channel contains a directional component in the direction of rotation of the opener roller.

The auxiliary channel preferably tapers in the direction of the spinning element. In this manner, stretching of the fibers in the auxiliary channel on their way from opener roller housing into the spinning rotor is obtained. For design and functional reasons, it is possible to provide for the tapering of the auxiliary channel to be essentially in the opener roller housing.

The auxiliary channel need not be of very large dimensions. The outlet cross-section of the fiber feeding channel is advantageously one to four times the size of the outlet cross-section of the auxiliary channel.

It is in principle unimportant in which direction the auxiliary channel lets out into the spinning rotor since the direction of entry practically has no influence on the conveying of air and since the fiber quantity conveyed by this air stream is relatively small. In order to be able to introduce even these few fibers as much as possible in a stretched condition into the spinning rotor and to incorporate them into the yarn, the auxiliary channel lets out essentially in the direction of rotation of a spinning element in the form of a spinning rotor in another advantageous embodiment.

Additional improvements in the incorporation of the fibers fed through the auxiliary channel to the spinning rotor can be achieved according to the invention in that the fiber feeding channel, as well as the auxiliary channel, let out in a common slit which extends parallel to the plane defined by the collection groove and is oriented in the direction of the conical inner wall of the spinning rotor. It has been shown to be advantageous in this instance for the fiber feeding channel and the auxiliary channel to let out into the slit from the side away from the collection groove, whereby the outlet of the fiber feeding channel is located at a narrow angle before the opening of the auxiliary channel (as seen in the direction of rotor rotation).

If the fiber flow is already switched on before piecing but has to be removed, so that the fibers do not reach the spinning element at first, until the fiber flow is fed to the spinning element in synchronization, another advantageous embodiment of the invention provides for the auxiliary channel to be connected to the interior of the opener roller housing via a valve and for the housing to be connected by means of this valve to an external auxiliary source of negative pressure during piecing. The air stream in the auxiliary channel is not controlled in this embodiment.

In a preferred embodiment the valve is made in the form of a turning-element valve with T-shaped channels of which one channel extends axially toward the turning-element valve which is connected to the auxiliary channel.

The device according to the invention is of simple construction and can easily be retrofitted into existing machines. Furthermore, low negative spinning pressure is sufficient, since it is not required to suck all of the needed air through the small outlet diameter of the fiber feeding channel. The lower negative spinning pressure leads to energy savings, and in addition to material and space savings, since the diameters of the air conveying parts can be smaller than usual because of the lower air flow rate in the channel. Nevertheless, fly fibers in the area of the feeding device are avoided and the danger of fibers circulating once or several times with the opener roller is reduced considerably.

Examples of embodiments of the invention are explained in greater detail below with the help of drawings, which are incorporated into the description.

DETAILED DESCRIPTION OF THE PREFERRED EMBODIMENTS

Figure 1:
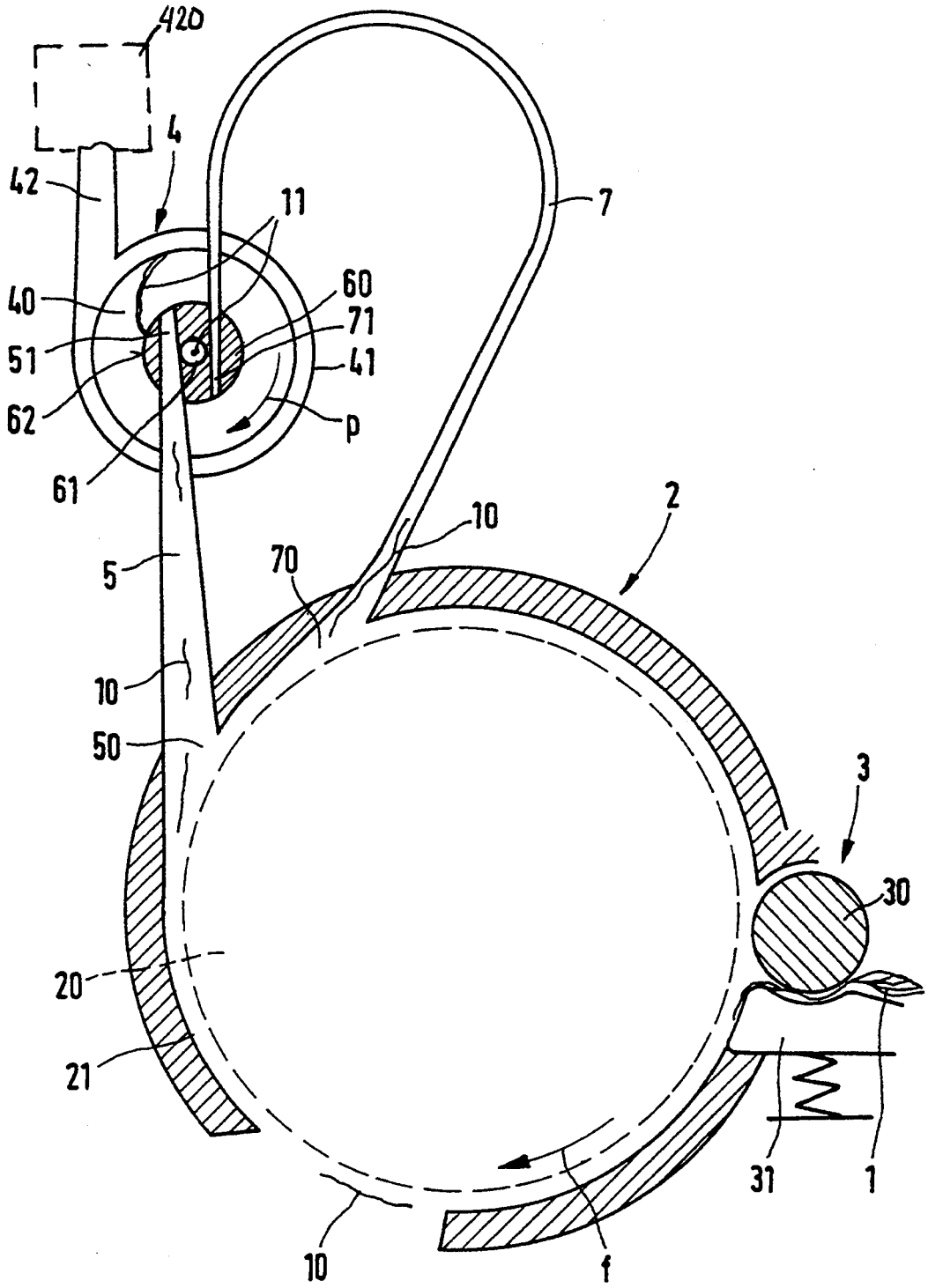
FIG. 1 shows a first embodiment of the open-end spinning device according to the invention in a schematic front view.

Reference will now be made in detail to the presently preferred embodiments of the invention, one or more examples of which are illustrated in the drawings. Each example is provided by way of explanation of the invention and not limitation of the invention. The numbering of components is consistent throughout the description with the same components having the same numbers in the drawings.

The invention is described first of all with the help of FIG. 1 which shows only those parts of an open-end spinning device which are needed to understand the invention.

To feed the fiber sliver 1 to an opener device 2, a feeding device 3 equipped in the usual manner with a feed roller 30 and a feed trough 31 interacting elastically with the latter is provided.

The opener device 2 is equipped with a opener roller 20 which is located in a housing (opener roller housing 21).

Downstream from the opener device 2 is the actual spinning device 4. The latter is provided with a spinning rotor 40 which is located in a housing (rotor housing 41). The latter is connected via a suction line 42 to a source of negative pressure (not shown).

A fiber feeding channel 5 extends from the opener device 2 into the spinning rotor 40, its inlet opening 50 being located in the peripheral wall of the opener roller housing 21 and the outlet opening 51 of which is located in an extension 60 of a cover 6 (see FIG. 3) covering the open side of the spinning rotor 40. The outlet of a yarn draw-off channel 61 is also located in the extension 60 of cover 6.

The design described until now is generally known in the art.

In spinning, the fiber sliver 1 is fed in such a device by means of the feeding device 3 to the opener device 2 which combs individual fibers 10 out of the forward end of the fiber sliver 1 and deposits them through the fiber feeding channel 5 on a fiber collection surface (collection groove 43, see FIG. 3) where the fibers 10 are incorporated into the end of a yarn 11 which is in turn withdrawn from the spinning rotor 40 by means of conventional (not shown) means through the yarn draw-off channel 61 and is conveyed to a winding station.

The fiber feeding channel 5 tapers from its inlet opening 50 in the direction of its outlet opening 51. This tapering is all the more pronounced as the outlet opening 51 is smaller, and this in turn depends on the diameter of the spinning rotor 40.

With the tendency in the art to always increase the rotational rotor speed so that the withdrawal speed of the yarn 11 can also be increased, ever smaller spinning rotors 40 are being used so as to keep energy costs (drive energy) as low as possible. Because of this decrease in rotor diameter, the extension 60 of the cover 6 necessarily also becomes smaller, so that less and less space is available in the area between the outlet of the yarn draw-off channel 61 and the outside perimeter 62 of the extension 60. This necessarily results in a need to reduce the cross-section of the outlet opening 51 of the fiber feeding channel 5 accordingly.

For the spinning process, in particular for the feeding of fibers 10 to the spinning rotor 40, a certain passage of air is indispensable. This could be achieved until now only by increasing the negative pressure applied to the suction line 42, accordingly leading to an undesirable increase in energy costs.

When the air flow rate through the spinning rotor 40 is lowered, the danger exists that not all of the fibers 10 are sucked out or thrown from the clothing of the opener roller 20 and are conveyed past the inlet opening 50 of the fiber feeding channel 5 so that they continue to circle with the opener roller 20. There is a danger then that these fibers settle first of all in the area of the feeding device 3 where the peripheral wall of the opener roller housing 21 is interrupted and that they be later torn lose at any moment, leading to an irregularity in the yarn 11 or even to yarn breakage, which is undesirable. In addition, the fibers 10 can come out of the opening on the opener roller housing 21 which receives the feeding device 3, together with the air which is prevented by the leading end of the fiber sliver 1 from circling with the opener roller 20 to settle in particular in the area of the feeding device 3, which is also undesirable.

In order to avoid these above-described disadvantages and the otherwise required high energy consumption, provisions are made according to FIG. 1 for an auxiliary channel 7 to be directed from the opener roller housing 21 into the spinning rotor 40 independently of the fiber feeding channel 5. The inlet opening 70 of the auxiliary channel is located in the peripheral wall of the opener roller housing 21, between the inlet opening 50 of the fiber feeding channel 5 and the feeding device 3 (as seen in the direction of fiber conveying (arrow f)).

According to FIG. 1, the auxiliary channel 7 lets out offset by approximately 180° in relation to the fiber feeding channel 5 into the spinning rotor 40. At the same time the fiber feeding channel 5, as well as the auxiliary channel 7, are arranged in the same direction in relation to the rotation of the rotor and both let out essentially in the direction of rotation (arrow p) of the spinning rotor 40 into the latter, so that the fibers conveyed with the auxiliary air stream through the auxiliary channel 7 reach the fiber collection surface of the spinning element, e.g. the collection surface 43 of the spinning rotor 40 (see FIG. 3) in the usual depositing orientation, since the inlet opening of the auxiliary channel 7 into the spinning rotor 40 has a directional component in the rotational direction of the opener roller 20.

The fibers 10 required to spin a yarn 11 are conveyed in the usual manner with the help of the fiber feeding channel 5 to the spinning rotor 40. Fibers 10 which may not have become detached from the clothing of the opener roller 20 in the area of the inlet opening 50 of the fiber feeding channel 5, are sucked out of the clothing of the opener roller 20 by the negative pressure effect prevailing at the inlet opening 70 of the auxiliary channel 7 and are also conveyed to the spinning rotor 40 where they are deposited on the fiber collection surface constituted by the collection groove 43 (FIG. 3) just as the fibers 10 fed by means of the fiber feeding channel 5, are collected and then incorporated into the end of yarn 11. This removal of the fibers 10 prevents them from being conveyed on to the feeding device 3. Fly fibers in feeding device 3 are prevented and yarn irregularities or even yarn breakage are prevented.

The total cross-section of the outlet opening 51 of the fiber feeding channel and of the outlet opening 71 of the auxiliary channel 7 can be selected with the described device without difficulty such that an optimal size of the overall outlet cross-section is achieved. In this manner it is possible to achieve the air flow rate required for spinning in a simple manner, even though only very little room is available in the extension 60 of the cover 6 for the different cross sections.

In order to keep the flow rate as high as possible in the fiber feeding channel 5, the latter will have as large a cross-section as possible in the vicinity of its outlet opening 51, so that the outlet opening 71 of the auxiliary channel 7 can be kept relatively small. It has been shown that it suffices if the outlet cross-section of the fiber feeding channel 5 is substantially one to four times the outlet cross-section of the auxiliary channel 7. In any case, the auxiliary channel 7 most be sized so that the air flow which it produces takes such strong effect in the vicinity of the feeding device that the detached fibers 11 and fiber fragments circling together with the opener roller 20 are removed.

Figure 2:
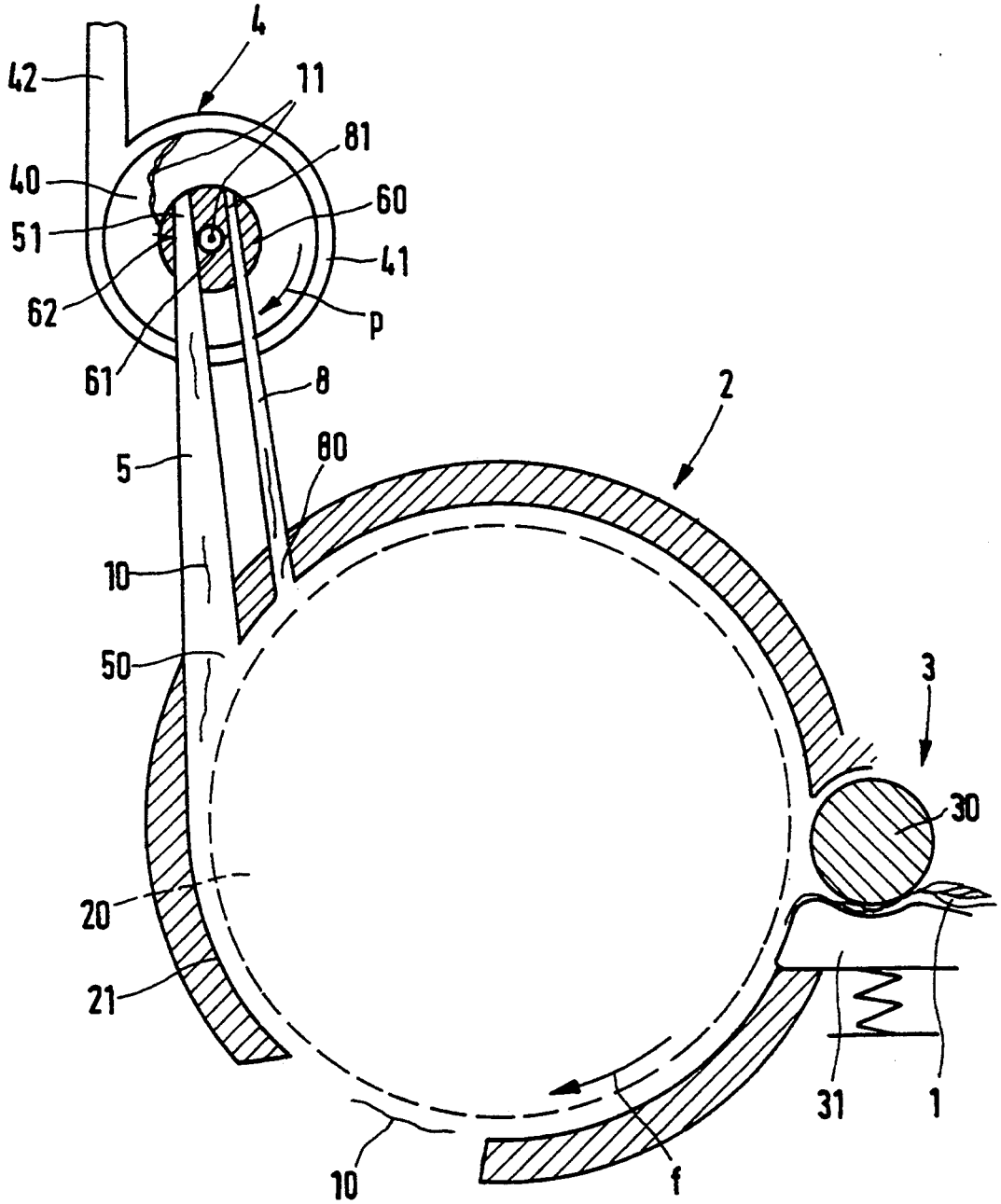
FIG. 2 shows a schematic front view of a modified embodiment of an open-end spinning device designed according to the invention.

According to FIG. 1 the inlet opening 70 of the auxiliary channel 7 is essentially oriented in the sense of rotation of the opener roller 20 since it is especially advantageous in this manner to remove the air and the fibers 10 conveyed with it from the opener roller housing 21. As FIG. 2 shows, it is however not an absolute condition, even though it is advantageous, for the inlet opening 70 of the auxiliary channel 7 to have a directional component in the direction of rotation (arrow f) of the opener roller 20.

For the fibers 10 fed to the spinning rotor 40 through the auxiliary channel 7 to be able to assume a stretched position, it is advantageous if the auxiliary channel 7 tapers as does the fiber feeding channel 5, from the opener roller 20 toward the spinning rotor 40. The auxiliary channel 7 with its inlet opening 70 will extend over the entire width of the peripheral wall of the opener roller housing 21 and will at the same time have a substantially rectangular cross-section, while its outlet opening 71 of the auxiliary channel 7 will have a round to oval cross-section. As shown in FIG. 1, it is advantageous for the passage from the rectangular into the round cross-section to take place essentially already in the area of the opener roller housing 21, so that the connection between the inlet opening 70 of the auxiliary channel and its outlet opening 71 can be established by means of a hose which can be attached to a connection piece of the opener roller housing 21. In this manner it is possible to easily achieve the required deflection of the auxiliary channel 7 (by means of the hose). In addition, stronger beginning flow is achieved in this manner, and this results in better stretching of the fibers since the speed difference between air and fiber is still relatively small at this point.

The described open-end spinning device can be modified in different manners within the framework of the instant invention, i.e. by replacing individual elements by equivalents or through some other combination of the described characteristics. Thus it is not absolutely necessary for the auxiliary channel to let out into the spinning rotor 40 in the direction of rotation of the latter. FIG. 2 shows an embodiment in which an auxiliary channel 8 is provided, the outlet opening 81 of which extends essentially at a parallel to the outlet opening 51 of the fiber feeding channel 5. Since there is only room for the outlet opening 51 of the fiber feeding channel 5 at the left of the yarn draw-off channel 61, between the latter and the outer periphery 62 of the extension 60 of cover 6 according to the representation of Fig. 2, the outlet opening 81 of the auxiliary channel 8 is on the right side of the yarn draw-off channel 61. As a result the auxiliary channel 8 lets out into the spinning rotor 40 in a direction opposite to the latter's direction of rotation (arrow f).

Since the fibers 10 fed to the spinning rotor 40 through the fiber feeding channel 5 have already been deposited on the inner wall of the spinning rotor 40 in the area where the suction air conveyed through the auxiliary channel 8 enters the spinning rotor 40, this air stream fed to the spinning rotor in a direction opposite to the direction of rotation of the spinning rotor can not impede the depositing of fibers. Furthermore, only individual fibers 10, i.e. relatively few fibers, are fed to the spinning rotor 40 through the auxiliary channel 8, so that the manner in which these few fibers 10 get into the spinning rotor 40 is not of crucial importance for the quality of the yarn 11.

As FIG. 2 shows, the fiber feeding channel 5 and the auxiliary channel 8 are substantially parallel to each other. For this reason the inlet opening 80 is relatively close behind the inlet opening 50 of the fiber feeding channel (in relation to the direction of rotation (arrow f) of the opener roller 20). In spite of this relatively close proximity of the two inlet openings, 50 of channel 5 and 80 of the auxiliary channel 8, the inlet opening 80 of the auxiliary channel 8 has a directional component in the direction of rotation of the opener roller 20 also in this embodiment.

In principle, the direction of this inlet opening 80 in relation to the direction of rotation of the opener roller 20 is however not of crucial importance. If the inlet opening 70 or 80 of the auxiliary channel 7 or 8 are closer to the feeding device 3 for example, so that a greater suction effect may be obtained in that area, it is absolutely possible to provide for the inlet opening 70 or 80 of the auxiliary channel 7 or 8 to have a directional component contrary to the direction of rotation (arrow f) of the opener roller 20. This is possible in particular if, as spinning rotors 40 with greater diameters are used, the outlet opening 51 of the fiber feeding channel 5 may also have a relatively large cross-section.

Figure 3:
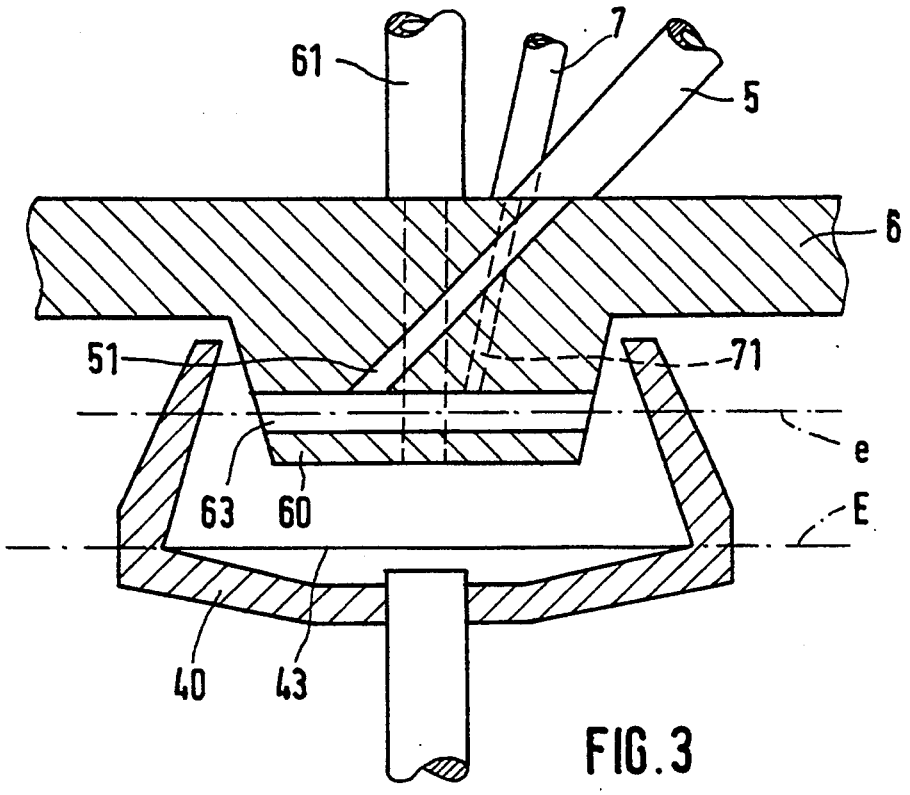
FIG. 3 shows a cross-section of a spinning rotor and part of a rotor cover with the inlet of an auxiliary channel according to the invention.
Figure 4:
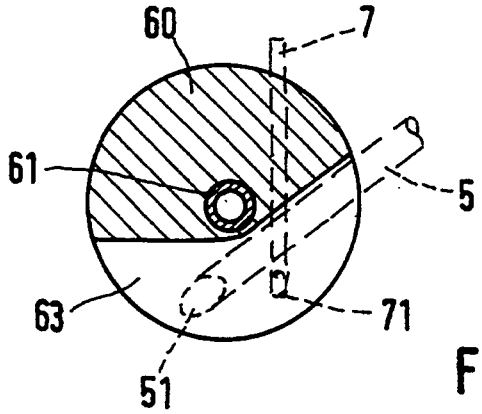
FIG. 4 shows the device shown in FIG. 3 from the front, in partial section.

In order to achieve an especially well bundled feeding of the fibers 10 fed by means of fiber feeding channel 5 to the spinning rotor 40, as well as of those fibers 10 which are fed to the spinning rotor 40 by means of auxiliary channel 7, provisions are made according to FIGS. 3 and 4 for the fiber feeding channel 5 and the auxiliary channel 7 to let out in a joint slit 63 of the extension 60 of cover 6. This slit 63 extends parallel to the plane E going through the collection groove 43. This slit 63 thus causes fibers fed with the sucked air streams through fiber feeding channel 5, as well as the fibers fed through auxiliary channel 7, to reach the inner wall of the spinning rotor 40 essentially on a plane E on the conical inner wall of the spinning rotor 40, this plane being parallel to the plane E constituted by the collection groove 43.

In the shown embodiment, the fiber feeding channel 5, as well as the auxiliary channel 7, are not oriented randomly into the slit 63 but essentially toward the collection groove 43, and therefore let out into slit 63 from the side away from the collection groove 43.

In the embodiment shown in FIG. 4, the outlet of the fiber feeding channel 5 is installed at a sharp angle, e.g. an angle of 60° (in relation to the rotor rotation device), before the outlet of the auxiliary channel 7, since the fibers 11 emerging from the two channels 5 and 7 do not influence each other in this way if the space in the extension 60 of cover 6 is well utilized.

In the shown embodiments, the air circling with the opener roller 20 is removed from the area which does not normally convey fibers, independently of the fiber feeding into the spinning element (e.g. into a spinning rotor 40 or into the nip of functional spinning elements), and is thereby always fed back instead to the spinning process. This is especially advantageous from the point of view of economy since all the fibers are spun. When the quality requirements for the spun yarn 11 are extremely high, it may however be advantageous to scrap the fibers which have not detached themselves from the clothing of the opener roller 20 at the latest in the vicinity of fiber feeding channel 5, so that only fiber stream which has gone through the fiber feeding channel 5 to the spinning element is finally used for spinning. For this purpose the auxiliary channel 7 is connected directly to the source of negative pressure (not shown) and not via the rotor housing 41.

Figure 5:
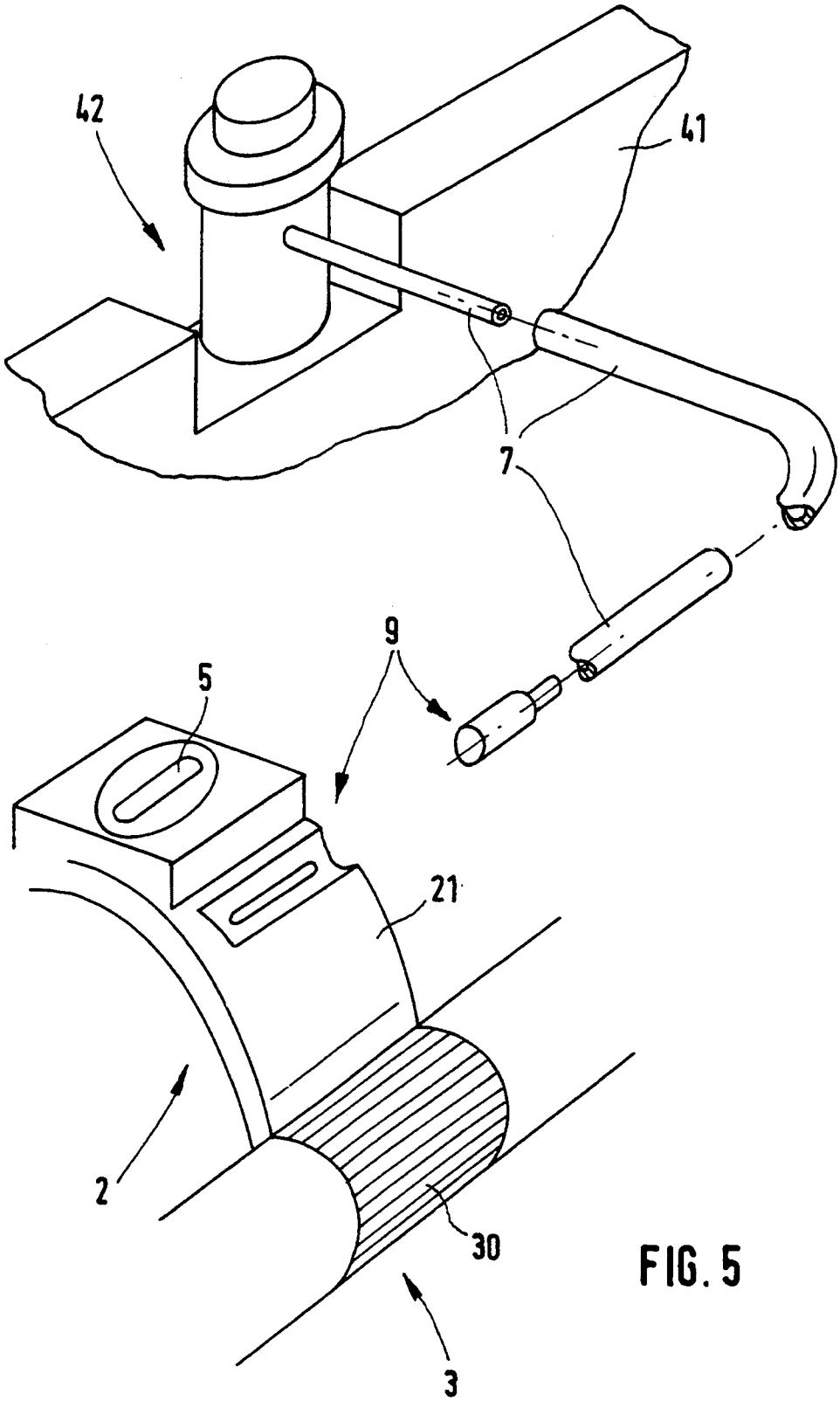
FIG. 5 shows an exploded perspective view of a variant of the device according to the invention, with a turning-element valve.

FIG. 5 shows another variant of the described device. In this embodiment, in the direction of rotation of the opener roller 20 after the inlet opening 50 into the fiber feeding channel 5 (see FIGS. 1 and 2) at the location of the inlet opening 70 shown there, a valve 9, which may be in the form of a turning-body valve to which an auxiliary suction channel 90 is connected, may be provided. The valve 9 is provided with internal T-shaped channels 91 and 92 which extend at a perpendicular to the cylinder-shaped body of the valve. Channel 91 extends in this case diametrically through the valve body and, when adjusted radially to the opener roller 20, establishes the connection between the interior of the housing 21 containing the opener roller 20 and the auxiliary suction channel 90. If the valve body is rotated by 90°, channel 92, which is placed at a right angle to channel 91 and extends radially out, is in its radial position in relation to opener roller 20 and connects the interior of the housing 21 to channel 91. These two switch positions, between which the valve 9 can be switched back and forth, are shown in FIGS. 6 and 7.

Figure 8:
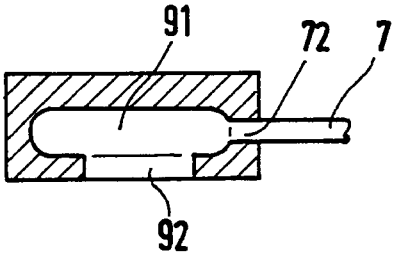
FIG. 8 shows the valve body of the turning-element valve in a longitudinal section.

An additional channel 72 to which the auxiliary channel 7 is connected lets out in axial direction (as related to the cylinder shape of the valve 9) at the location where channel 92 lets out into channel 91 (see FIG. 8).

Figure 6:
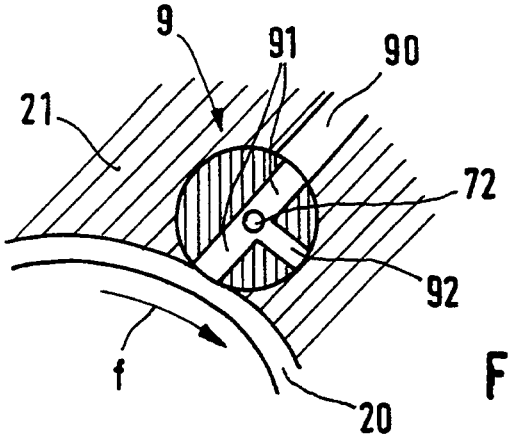
FIGS. 6 and 7 show a section of the turning-element valve shown in FIG. 5, in its two operating positions.
Figure 7:
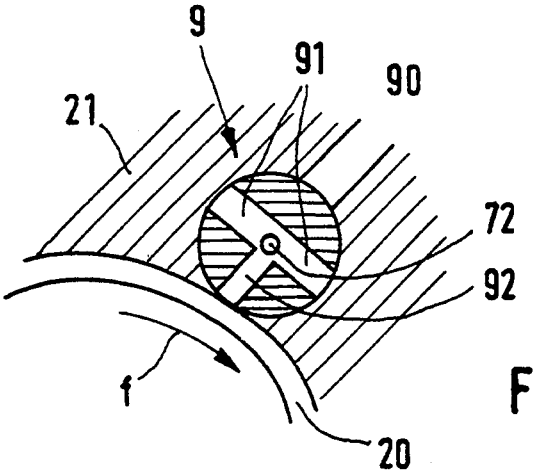

During the preparations for piecing, the valve 9 is in the position shown in FIG. 6, in which the interior of the housing 21 is connected to the auxiliary suction channel 90 which is subjected to a relatively strong negative pressure. Fiber feeding is now switched on in the usual manner. The fibers 10 which were separated by the opener roller 20 are sucked into the auxiliary suction channel 90 and removed. For the back-feeding of a yarn end into the spinning rotor or on the fiber collection surface of another open-end spinning element as is required for piecing, the valve 9 is brought into the position shown in FIG. 7 and a negative spinning pressure is brought into action in or at the spinning element 40. The fibers 10 now reach the spinning rotor 40 from where the previously back-fed yarn 11 is withdrawn while fibers 10 are continuously incorporated.

As in the previously described embodiments, negative pressure takes effect continuously here too via auxiliary channel 7 during the entire duration of production into the interior off the housing 21 containing the opener roller 20 so as to avoid fly fibers in the feeding device 3.

In the described embodiment, the air stream sucked into the auxiliary channel 7 or 8 is not controlled, although it can of course also be switched on and off. The negative pressure which is applied by means of an external auxiliary negative-pressure source (not shown) to the auxiliary suction channel 90 is however so strong by comparison to the negative pressure taking effect in the auxiliary channel 7 or 8 that the fibers 10 are prevented from entering the auxiliary channel 7 and are certain to be removed through the auxiliary suction channel 90. The fact that channel 91 established a straight connection between the interior of housing 21 and the auxiliary suction channel 90 also contributes to this, while the air stream sucked into the auxiliary channel 7 or 8 must be deflected in order to reach channel 72. Thus, no fibers 10 are conveyed there, even if the auxiliary channel 7 or 8 let out in or at the spinning rotor 40, especially since the negative spinning pressure to be brought into action in or at the spinning element 40 is switched off during fiber removal through the auxiliary suction channel 90.

Instead of providing a turning-body valve at the indicated location, it is also possible to make the inlet opening 70 or 80 of the auxiliary channel 7 or 8 relatively large and to have the auxiliary suction channel 90 branch off from the auxiliary channel 7 or 8. The valve (which is provided only for opening and closing) is then installed in the auxiliary suction channel 90.

It will be apparent to those skilled in the art that various modifications and variations can be made in the present invention without departing from the scope or spirit of the invention. For example, features illustrated as part of one embodiment can be combined with another embodiment to yield a still further embodiment. Thus, it is intended that the present invention cover such modifications and variations as come within the scope of the appended claims and their equivalents.

I claim:

1. A process for open-end spinning in which a fiber sliver is conveyed by means of a feeding device to an opener roller located in a housing to be opened into individual fibers, the individual fibers being conveyed by an airstream through a fiber channel to a fiber collection surface of a spinning element to be spun into yarn, said process comprising drawing an auxiliary airstream independent from the airstream through the fiber channel from the opener roller housing at a point past the location of the fiber channel opening in the opener roller housing in the direction of rotation of the opener roller, and with said auxiliary airstream and independent of fiber feeding through the fiber channel removing fibers and fiber fragments that were not drawn off through the fiber channel so that these fibers and fiber fragments do not adversely interfere with the spinning process.

2. The process as in claim 1, further comprising introducing the auxiliary airstream into the spinning element so that the fibers conveyed by the auxiliary airstream are deposited on the fiber collection surface.

3. The process as in claim 2, further comprising depositing the auxiliary airstream fibers on the fiber collection surface in the same direction as the fiber channel deposits fibers on the fiber collection surface.

4. An open-end spinning device, comprising:

a spinning element for spinning individual fibers into yarn, an opener roller operably carried in an opener roller housing for opening a fiber sliver into individual fibers, said opener roller housing generally surrounding said opener roller;

a feeding device for feeding a fiber sliver to said opener roller;

a fiber feeding channel with an inlet opening in a peripheral wall of said opener roller housing and an outlet directed toward said spinning element, said fiber feeding channel extending from said opener roller housing to said spinning element and connected to a negative pressure source for conveying fibers from said opener roller to said spinning element; and an auxiliary fiber channel having an inlet opening located in said peripheral wall of said opener roller housing between said fiber feeding channel inlet opening and the location where said feeding device feeds a fiber sliver to said opener roller, said auxiliary fiber channel configured in communication with a negative pressure source independently from said fiber feeding channel such that said auxiliary fiber channel is not in communication with its respective negative pressure source through said fiber feeding channel, said auxiliary fiber channel disposed so as to remove fibers and fiber fragments from said opener roller that were not drawn off by said fiber feeding channel so that said fibers and fiber fragments will not adversely interfere with the spinning process.

5. The device as in claim 4, wherein said auxiliary fiber channel comprises an outlet directed to let out into the spinning element.

6. The device as in claim 5, wherein said auxiliary fiber channel tapers in the direction of said spinning element.

7. The device as in claim 6, wherein said auxiliary fiber channel is tapered essentially within said opener roller housing.

8. The device as in claim 5, wherein the cross-section area of said fiber feeding channel outlet is from one to four times that of said auxiliary fiber channel.

9. The device as in claim 5, wherein said spinning element includes a conical inner surface and defining a collection groove therein, said auxiliary channel outlet configured with a tangential directional component in the rotational direction of said spinning element.

10. The device as in claim 9, wherein said fiber feeding channel and said auxiliary fiber channel let out in a common slit, said slit extending parallel to the plane of said spinning element collection groove and directed to deposit fibers onto said spinning element conical inner surface.

11. The device as in claim 10, wherein said fiber feed ing channel and said auxiliary fiber channel lead out both into said common slit from the side away from said plane of said spinning rotor collection groove.

12. The device as in claim 5, wherein said fiber feeding channel outlet lets out into said spinning element before said auxiliary fiber channel in the direction of rotation of said spinning element.

13. The device as in claim 12, wherein said fiber feeding channel outlet forms an angle of at least less than 90 degrees with a horizontal plane through said spinning element.

14. The device as in claim 4, wherein said auxiliary fiber channel inlet is configured with a tangential directional component in the direction of rotation of the opener roller.

15. The device as in claim 4, wherein said fiber feeding channel and said auxiliary fiber channel are in communication with a common said negative pressure source.

16. The device as in claim 15, wherein said fiber feeding channel and said auxiliary fiber channel are in communication with said same negative pressure source through said spinning element.

17. An open-end spinning device, comprising:

a spinning element for spinning individual fibers into yarn, an opener roller operably carried in an opener roller housing for opening a fiber sliver into individual fibers, said opener roller housing generally surrounding said opener roller;

a feeding device for feeding a fiber sliver to said opener roller;

a fiber feeding channel with an inlet opening in a peripheral wall of said opener roller housing and an outlet directed toward said spinning element, said fiber feeding channel extending from said opener roller housing to said spinning element and connected to a negative pressure source for conveying fibers from said opener roller to said spinning element;

an auxiliary fiber channel having an inlet opening located in said peripheral wall of said opener roller housing between said fiber feeding channel inlet opening and the location where said feeding device feeds a fiber sliver to said opener roller, said auxiliary fiber channel connected to a negative pressure source independently from said fiber feeding channel, said auxiliary fiber channel disposed so as to remove fibers and fiber fragments from said opener roller that were not drawn off by said fiber feeding channel so that said fibers and fiber fragments will not adversely interfere with the spinning process; and an auxiliary negative pressure source connected with an auxiliary suction channel in communication with the interior of said opener roller housing through a switchable valve, said auxiliary fiber channel also in continuous communication with the interior of said opener roller housing through said valve, said valve switchable between a first position wherein during piecing said auxiliary suction channel draws a suction on the interior of said opener roller housing and a second position wherein said auxiliary suction channel is blocked from drawing a suction on the interior of said opener roller housing.

18. The device as in claim 17, wherein said valve comprises a turning body defining intersecting channels, one of said channels connecting said auxiliary suction channel to said opener roller housing in said first position, and the other of said channels connecting only said auxiliary fiber channel to said opener roller housing in said second position.

* * * * *